US006351207B1

(12) United States Patent
Mik et al.

(10) Patent No.: US 6,351,207 B1
(45) Date of Patent: Feb. 26, 2002

(54) MEDICATION REMINDER KEY CHAIN

(76) Inventors: Cynthia J. Mik; Anna Sobrero, both of 1705 Ganges Ave., El Cerrito, CA (US) 94530

( * ) Notice: Subject to any disclaimer, the term of this patent is extended or adjusted under 35 U.S.C. 154(b) by 0 days.

(21) Appl. No.: 09/614,246

(22) Filed: Jul. 12, 2000

(51) Int. Cl.[7] ..... G08B 1/00

(52) U.S. Cl. ..... 340/309.15; 340/309.4; 340/309.5; 206/37; 206/38

(58) Field of Search ..... 340/309.15, 309.4, 340/309.5; 206/37, 37.1, 38, 38.1

(56) References Cited

U.S. PATENT DOCUMENTS 3,818,476 A * 6/1974 Murray et al. ..... 340/309.4
4,420,076 A * 12/1983 Beveridge ..... 206/37
4,490,711 A * 12/1984 Johnston ..... 340/309.4
4,765,459 A * 8/1988 Edwards ..... 206/38.1
4,849,948 A * 7/1989 Davis et al. ..... 340/309.15
D406,542 S 3/1999 Mik
6,018,289 A * 1/2000 Sekura et al. ..... 340/309.4

* cited by examiner

*Primary Examiner*—Jeffery Hofsass
*Assistant Examiner*—Daniel Previl
(74) *Attorney, Agent, or Firm*—Carol P. Titus; James J. Leary

(57) ABSTRACT

Medication Reminder Key chain with a key chain sized housing enclosing a printed circuit board, the printed circuit board supporting an integrated circuit providing timing functions and control for a piezo electric sound emitting device and a plurality of LED's, the printed circuit board also supporting a momentary switch, the printed circuit board also supporting a battery holder and associated battery. A preferred embodiment includes in said timing functions the actuation of said sound emitting device at regular intervals.

16 Claims, 3 Drawing Sheets

MEDICATION REMINDER KEY CHAIN

BACKGROUND OF THE INVENTION

This invention relates generally to the field of electronic timing devices, and more particularly to a medication reminder key chain.

Electronic timing devices are known and have been used for many years in various applications including: count down timers, interval timers, clocks, watches and the like. One type of activity that can benefit from a timing device is the taking of medication at regular intervals. If a person forgets to take his or her medication it could result in adverse consequences ranging from prolonged time to cure an illness to serious physical breakdowns. A number or timing devices have appeared in the market over the past twenty years that claim to help people keep track of medication taking times. Although many of these timing devices provide some effectiveness in reminding a person to take medication, there are certain short comings to the existing designs that have not been addressed. One short coming is that all of the existing medication timing devices available today require the user to program the timing device to set up the times when an audible alarm is to sound. Although the act of programming can appear simple to those versed in the handling of electronic gadgets, others, especially older people are incapable of executing such a programming sequence. Additionally, a programming sequence generally requires a visual display, such as a liquid crystal display, to assist in the program procedure. This display adds to the cost, size and complexity of the medication timing device. Finally, most existing medication timing devices do not have the ability for the user to be able to easily repeat the audible sound a short time after the sound has originally been produced as is needed when a person, for some reason, can not take the medication at the time of the original sounding of the audible device.

SUMMARY OF THE INVENTION

The primary object of the invention is to provide key chain sized device that helps remind a person to take their medication at regular intervals during the day.

Another object of the invention is to provide a medication reminder device that requires no programming by the user.

Another object of the invention is to provide a medication reminder device that emits an audible signal to help remind a person to take their medication.

A further object of the invention is to provide a medication reminder device that incorporates a delay feature so that if a person can not take his or her medication at the time of the audible signal, the person can have the device remind then again a short time later.

Yet another object of the invention is to provide a medication reminder device that incorporates a plurality of LED's, one for each pill taking time period.

Other objects and advantages of the present invention will become apparent from the following descriptions, taken in connection with the accompanying drawings, wherein, by way of illustration and example, an embodiment of the present invention is disclosed.

Medication Reminder Key chain comprising: a key chain sized housing enclosing a printed circuit board, said printed circuit board supporting an integrated circuit providing timing functions and control for a piezo electric sound emitting device and a plurality of LED's, said printed circuit board also supporting a momentary switch, said printed circuit board also supporting a battery holder and associated battery.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
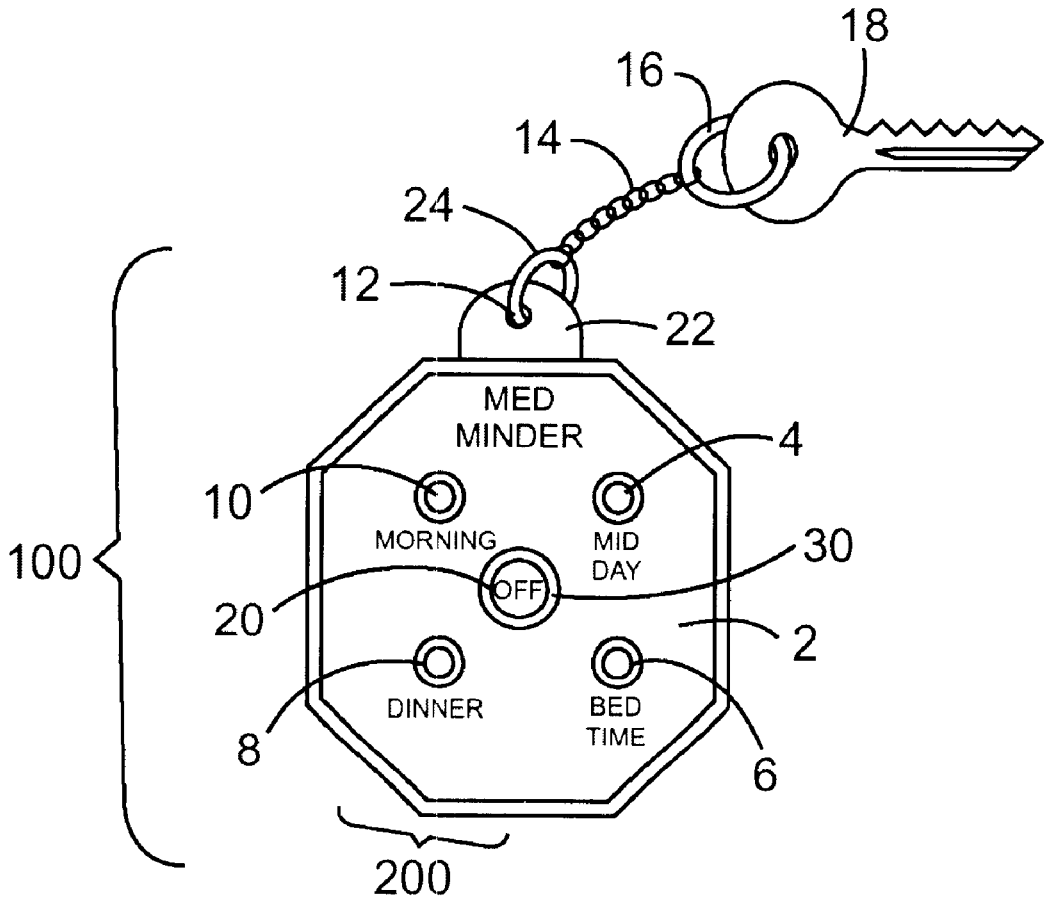
FIG. 1 is a front view of the medication reminder key chain of the present invention.
Figure 2:
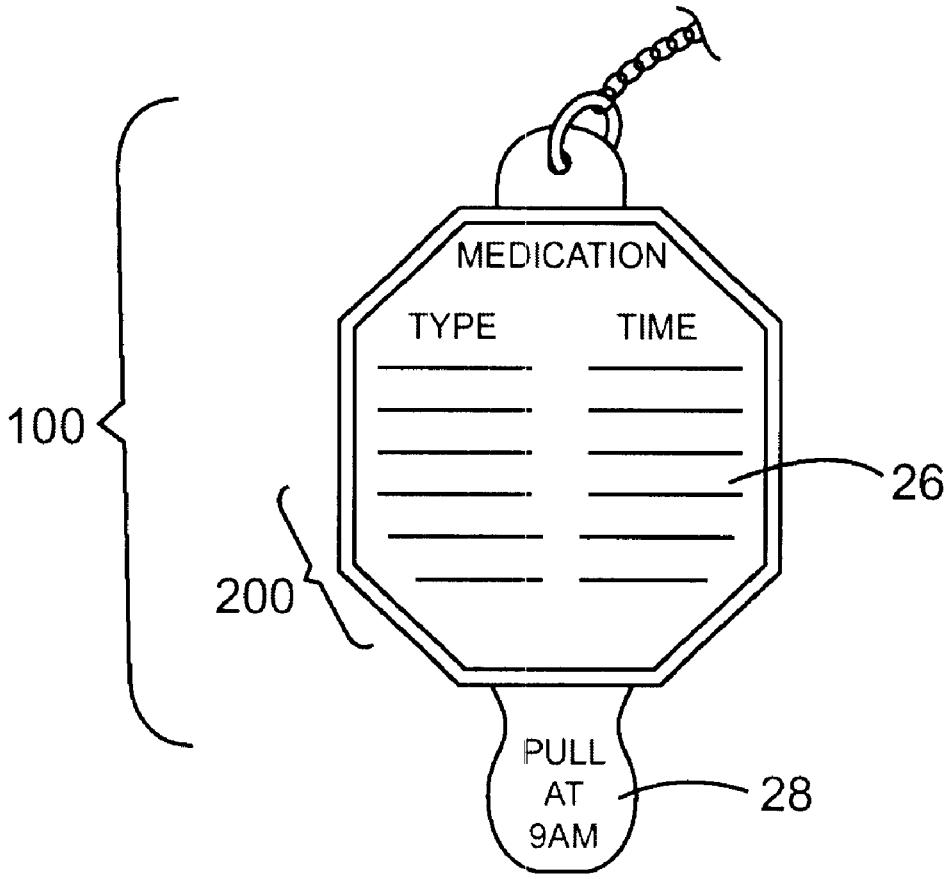
FIG. 2 is a rear view of the medication reminder key chain of the present invention.

Referring now to FIG. 1 we see a front view of the medication reminder key chain 100 of the present invention. The housing 200 of the preferred embodiment shown is in the shape of a stop sign to help reinforce the idea of stopping to take one's medication. Chain holding tab 22, hole 12, ring 24, chain 14, ring 16 and key 18 are all common to standard key chains. A plurality of light emitting diodes, known as LED's 4, 6, 8, 10 are located on the front panel 2 and each light up at the appropriate time, morning, mid day, dinner, bed time. The "off" switch 20, located in the center of panel 2, allows the user to turn off the audible alarm and LED. When the user pushes the off button 20 for a period of two seconds or longer, the audible alarm will remain off until the next pill taking time. If the user pushes the button for one second or less, the audible alarm will activate again in ten minutes. This feature is valuable when the user is not able to take the medication during the first alarm episode. By pressing the off button 20 for a short period, the user can remind himself again in ten minutes. This procedure can be repeated until the person finally takes his or her medication, at which time the user would press the off button 20 for two seconds or more. Button surround area 30 is raised slightly above the height of button 20 thereby preventing accidental pushing of button 20 when the device is in a person's pocket. FIG. 2 shows a rear view of the medication timer 100 of the present invention. On the rear side of housing 200 a person can write the names and time intervals of each medication taken on graphic panel 26 applied to housing 200. The unit 100 comes with a pull tab 28 in place. On the first day of use the user pulls the tab at nine AM. The pulling of tab 28 causes an integral flat membrane within housing 200 to dislodge. Pull tab 28 will be further explained in FIG. 3.

Figure 3:
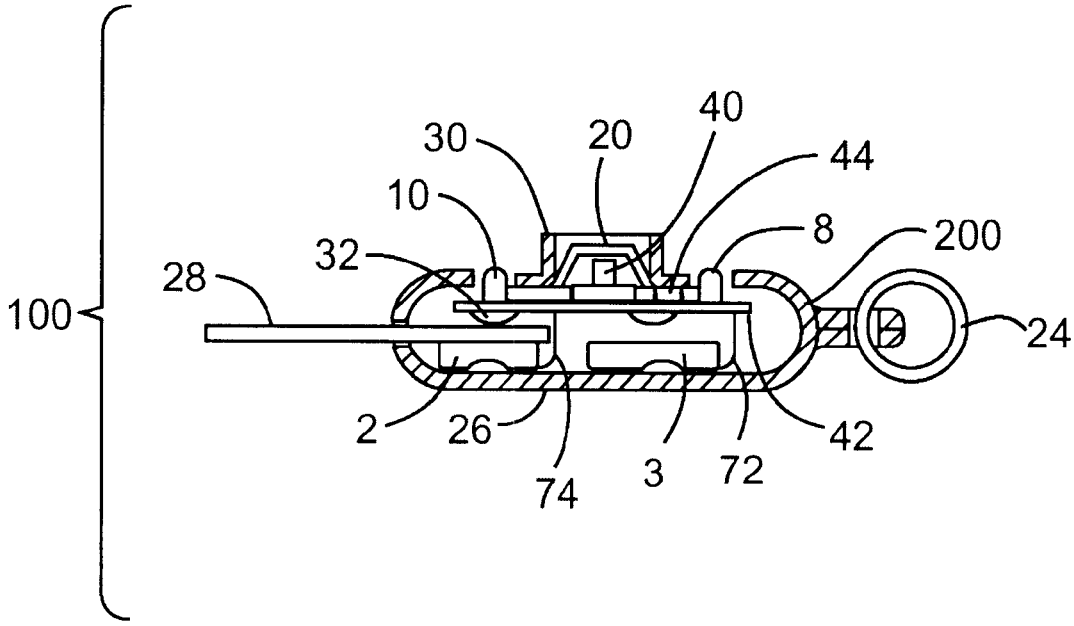
FIG. 3 is a side section view of the medication reminder key chain of the present invention.

FIG. 3 shows a side section view of the present invention 100. Tab 28 can be seen entering housing 200 and causing a seperation between battery contact 32 and battery 2. This separation interrupts the circuit enclosed within housing 200. When the user purchases the present invention he or she is instructed to pull tab 28 out of housing 200 at nine AM In doing so the timing circuit is activated and from that point on the device 100 will produce an audible signal daily at nine AM, one PM, five PM and nine PM. These are the times that are prescribed for most daily medications to be taken. The section view in FIG. 3 also shows circuit board 42 and attached components including battery holders 72, 74, LED's 8, 10, Switch 44. Battery holders 72, 74 hold batteries 2, 3. Surrounding concentric wall 30 prevents push button membrane 20 from being accidentally pushed when the device 100 is in a persons pocket or purse.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A medication reminder key chain, comprising:

a piezo electric sound emitting device, a momentary switch, a printed circuit board having a timing function and a control for said piezo electric sound emitting device, said timing function configured to have a plurality of alarm cycles preset to activate the piezo electric sound emitting device at a plurality of preset times, said timing function also configured to:

when said momentary switch is pressed for more than a first preselected period of time, turn off said piezo electric sound emitting device until a subsequent alarm cycle, when said momentary switch is pressed for less than a second preselected period of time, turn off said piezo electric sound emitting device for a third preselected period of time after which said piezo electric sound emitting device is reactivated, and a housing enclosing said printed circuit board and said piezo electric sound emitting device, said housing having said momentary switch located on an exterior surface thereof, the housing sized and configured to act as a key chain.

2. The medication reminder key chain of claim 1, further comprising at least one LED that is activated when said piezo electric sound emitting device is activated.

3. The medication reminder key chain of claim 1, further comprising at least one LED that is activated only when said piezo electric sound emitting device is activated.

4. The medication reminder key chain of claim 1, further comprising a battery holder and a battery connected with said printed circuit board.

5. The medication reminder key chain of claim 4, further comprising a flat tab having a first end and a second end, said first end located between the battery and a battery contact, said second end extending out of said housing, and wherein said timing function is initiated by the user when the user pulls said flat tab, thereby allowing electrical contact between said battery and said battery contact.

6. The medication reminder key chain of claim 1, further comprising a flat graphic area sized and configured to allow a user to record medications being taken.

7. The medication reminder key chain of claim 1, wherein said housing is octagonal.

8. A medication reminder key chain, comprising:

a piezo electric sound emitting device, a momentary switch, a printed circuit board having a timing function and a control for said piezo electric sound emitting device, said timing function configured to have a plurality of alarm cycles preset to activate the piezo electric sound emitting device at a plurality of preset times, a housing enclosing said printed circuit board and said piezo electric sound emitting device, said housing having said momentary switch located on an exterior surface thereof, the housing sized and configured to act as a key chain, and a first LED, a second LED, a third LED and a fourth LED, wherein said plurality of alarm cycles are four alarm cycles, wherein said plurality of preset times is four preset times, and wherein said first LED is activated at said first preset time, said second LED is activated at said second preset time, said third LED is activated at said third preset time and said fourth LED is activated at said fourth preset time.

9. The medication reminder key chain of claim 8, wherein said timing function is configured to:

when said momentary switch is pressed for more than a first preselected period of time, turn off said piezo electric sound emitting device until a subsequent alarm cycle, when said momentary switch is pressed for less than a second preselected period of time, turn off said piezo electric sound emitting device for a third preselected period of time after which said piezo electric sound emitting device is reactivated.

10. A medication reminder key chain, comprising:

a piezo electric sound emitting device, a first LED, a second LED, a third LED, a fourth LED a momentary switch, a printed circuit board having a timing function, a control for said piezo electric sound emitting device, a battery holder and a battery, said timing function configured to have four alarm cycles, the first alarm cycle activating said piezo electric sound emitting device and said first LED at a first preset time, the second alarm cycle activating said piezo electric sound emitting device and said second LED at a second preset time, the third alarm cycle activating said piezo electric sound emitting device and said third LED at a third preset time and the fourth alarm cycle activating said piezo electric sound emitting device and said fourth LED at a fourth preset time, said timing function configured to:

when said momentary switch is pressed for more than a first preselected period of time, turn off said piezo electric sound emitting device and the LED corresponding to the current alarm cycle until a subsequent alarm cycle, when said momentary switch is pressed for less than a second preselected period of time, turn off said piezo electric sound emitting device and the LED corresponding to the current alarm cycle for a third preselected period of time after which said piezo electric sound emitting device and the current LED is reactivated, a housing enclosing said printed circuit board and said peizo electric sound emitting device, said housing having said momentary switch and said first, second, third and fourth LED's located on an exterior surface thereof, the housing sized and configured to act as a key chain.

11. The medication reminder key chain of claim 10 wherein said LED's are activated only when said piezo electric sound emitting device is activated.

12. The medication reminder key chain of claim 10, further comprising a battery holder and a battery connected with said printed circuit board.

13. The medication reminder key chain of claim 12, further comprising a flat tab having a first end and a second end, said first end located between the battery and a battery contact, said second end extending out of said housing, and wherein said timing function is initiated by the user when the user pulls said flat tab, thereby allowing electrical contact between said battery and said battery contact.

14. The medication reminder key chain of claim 10, further comprising a flat graphic area sized and configured to allow a user to record medications being taken.

15. The medication reminder key chain of claim 10, wherein said housing is octagonal.

16. A medication reminder key chain, comprising:

a piezo electric sound emitting device, a first LED, a second LED, a third LED, a fourth LED a momentary switch, a printed circuit board having a timing function, a control for said piezo electric sound emitting device, a battery holder and a battery, said timing function configured to have four alarm cycles, the first alarm cycle activating said piezo electric sound emitting device and said first LED at a nine AM, the second alarm cycle activating said piezo electric sound emitting device and said second LED at one PM, the third alarm cycle activating said piezo electric sound emitting device and said third LED at five PM and the fourth alarm cycle activating said piezo electric sound emitting device and said fourth LED at nine PM, said timing function configured to:

when said momentary switch is pressed for more than two seconds, turn off said piezo electric sound emitting device and the LED corresponding to the current alarm cycle until a subsequent alarm cycle, when said momentary switch is pressed for less than one second, turn off said piezo electric sound emitting device and the LED corresponding to the current alarm cycle for ten minutes after which said piezo electric sound emitting device and the current LED is reactivated, a generally flat, octagonal housing enclosing said printed circuit board and said peizo electric sound emitting device, said housing having said momentary switch and said first, second, third and fourth LED's located on a front surface thereof, the housing sized and configured to act as a key chain, a raised area of said housing surrounding said momentary switch, a flat graphic area sized and configured to allow a user to record medications being taken, said graphic area located on a back surface of said housing, a flat tab having a first end and a second end, said first end located between the battery and a battery contact, said second end extending out of said housing, wherein said timing function is initiated by the user when the user pulls said flat tab, thereby allowing electrical contact between said battery and said battery contact.

* * * * *